US011603862B2

(12) United States Patent
Nelson et al.

(10) Patent No.: US 11,603,862 B2
(45) Date of Patent: Mar. 14, 2023

(54) DUAL PLATE MOTOR SUPPORT FOR HORIZONTAL PUMPING SYSTEM

(71) Applicant: Baker Hughes ESP, Inc., Houston, TX (US)

(72) Inventors: Andrew Michael Nelson, Oklahoma City, OK (US); Johnathan Edward Peterson, Oklahoma City, OK (US)

(73) Assignee: Baker Hughes ESP, Inc., Houston, TX (US)

( * ) Notice: Subject to any disclaimer, the term of this patent is extended or adjusted under 35 U.S.C. 154(b) by 563 days.

(21) Appl. No.: 15/516,438

(22) PCT Filed: Oct. 1, 2014

(86) PCT No.: PCT/US2014/058690
§ 371 (c)(1),
(2) Date: Apr. 3, 2017

(87) PCT Pub. No.: WO2016/053335
PCT Pub. Date: Apr. 7, 2016

(65) Prior Publication Data

US 2017/0248158 A1 Aug. 31, 2017

(51) Int. Cl.

| | |
|---|---|
| ***F04D 29/62*** | (2006.01) |
| ***F04D 13/02*** | (2006.01) |
| ***F04D 1/06*** | (2006.01) |
| ***F04D 13/06*** | (2006.01) |
| ***F04D 29/60*** | (2006.01) |
| ***F04D 1/00*** | (2006.01) |

(52) U.S. Cl.
CPC ..... *F04D 29/628* (2013.01); *F04D 1/00* (2013.01); *F04D 1/06* (2013.01); *F04D 13/02* (2013.01); *F04D 13/06* (2013.01); *F04D 29/605* (2013.01)

(58) Field of Classification Search
CPC . F04D 13/02; F04D 13/06; F04D 1/00; F04D 1/06; F04D 29/605; F04D 29/628; F16M 7/00
See application file for complete search history.

(56) References Cited

U.S. PATENT DOCUMENTS 1,922,050 A 8/1933 Bour
4,085,914 A * 4/1978 Gavin ..... F16M 7/00 248/678

(Continued)

FOREIGN PATENT DOCUMENTS

RU 2484305 C1 6/2013

OTHER PUBLICATIONS

International Search Report and Written Opinion issued in connection with corresponding PCT Application No. PCT/US2014/058690 dated Jun. 29, 2015.

(Continued)

*Primary Examiner* — Dominick L Plakkoottam
(74) *Attorney, Agent, or Firm* — Crowe & Dunlevy, P.C.

(57) ABSTRACT

A frame for supporting a horizontal pumping system includes a base assembly and a motor support assembly connected to the base assembly. The motor support assembly includes an upper support plate having a top and a bottom, a first lower support plate connected to the upper support plate, and a second lower support plate connected to the upper support plate. The first and second lower support plates are connected to the upper plate with bolted and welded connections.

3 Claims, 4 Drawing Sheets

(56) References Cited

U.S. PATENT DOCUMENTS

| | | | | |
|---|---|---|---|---|
| 4,759,904 | A * | 7/1988 | Gillett | G21C 1/086 376/353 |
| 5,183,286 | A * | 2/1993 | Ayabe | B60G 7/02 280/124.1 |
| 5,497,708 | A * | 3/1996 | Jeruzal | B65D 19/44 108/54.1 |
| 6,405,992 | B1 | 6/2002 | Palmer | |
| 6,425,735 | B1 | 7/2002 | Sheth | |
| 6,450,782 | B1 * | 9/2002 | Sakamoto | F04C 23/00 248/678 |
| 6,877,226 | B2 * | 4/2005 | Khattab | B61D 3/20 29/527.6 |
| 7,028,970 | B1 | 4/2006 | Wiseman | |
| 9,377,199 | B2 * | 6/2016 | Radlicz | F23R 3/06 |
| 9,780,345 | B2 * | 10/2017 | Heck | H01M 10/425 |
| 9,834,264 | B2 * | 12/2017 | Wylezinski | B62D 53/06 |
| 2003/0219347 | A1 | 11/2003 | Mascola | |
| 2008/0087650 | A1 * | 4/2008 | Wang | B23K 11/002 219/117.1 |
| 2009/0246039 | A1 | 10/2009 | Haack et al. | |
| 2010/0206856 | A1 * | 8/2010 | Tanaka | B23K 26/03 219/121.64 |

OTHER PUBLICATIONS

Office Action and Search issued in connection with corresponding RU Application No. 2017111238 dated Jul. 5, 2018.
Office Action issued in connection with corresponding CO Application No. 2017/0004345 dated Oct. 17, 2018.

* cited by examiner

DUAL PLATE MOTOR SUPPORT FOR HORIZONTAL PUMPING SYSTEM

FIELD OF THE INVENTION

This invention relates generally to the field of pumping systems, and more particularly to an improved system for supporting a large motor in a horizontal pumping system.

BACKGROUND

Horizontal pumping systems are used in various industries for a variety of purposes. For example, in the oil and gas industry horizontal pumping systems are used to pump fluids, such as water separated from oil, to a remote destination, such as a tank or disposal well. Typically these horizontal pumping systems include a pump, a motor, and a suction chamber positioned between the pump and the motor. A thrust chamber is also included between the motor and the suction chamber.

Each of these components is typically supported on the surface by one or more large frames. Specialized adapters are used to connect the components of the horizontal pumping system to the frame. These adapters match the frame to the motor plate and raise the motor into proper alignment with the pump. As horizontal pumping system increase in size and power, the weight, thrust and vibration exerted onto the frame also increase. Using prior art design guidelines, the motor support plates used to support very large motors would be complicated to manufacture and expensive. Accordingly, there is a need for an improved horizontal pumping system frame for large motors that is cost-effective and easy to manufacture. It is to these and other deficiencies in the prior art that the present invention is directed.

SUMMARY OF THE INVENTION

In a preferred embodiment, the present invention includes a frame for supporting a horizontal pumping system. The frame includes a base assembly and a motor support assembly connected to the base assembly. The motor support assembly includes an upper support plate having a top and a bottom, a first lower support plate connected to the upper support plate, and a second lower support plate connected to the upper support plate.

In another aspect, the preferred embodiments include a method for manufacturing a motor support assembly useable for supporting a motor within a horizontal pumping system. The method includes the steps of aligning an upper support plate on top of a lower support plate, bolting the lower support plate to the upper support plate and welding the lower support plate to the upper support plate through one or more weld access apertures extending through the lower support plate.

In yet another aspect, the preferred embodiments include a horizontal pumping system that includes a frame, a motor and a pump driven by the motor. The frame includes a base assembly and a motor support assembly connected to the base assembly. The motor support assembly includes an upper support plate having a top and a bottom, a first lower support plate connected to the upper support plate, and a second lower support plate connected to the upper support plate. The motor is supported by the motor support assembly.

DETAILED DESCRIPTION OF THE PREFERRED EMBODIMENT

Figure 1:
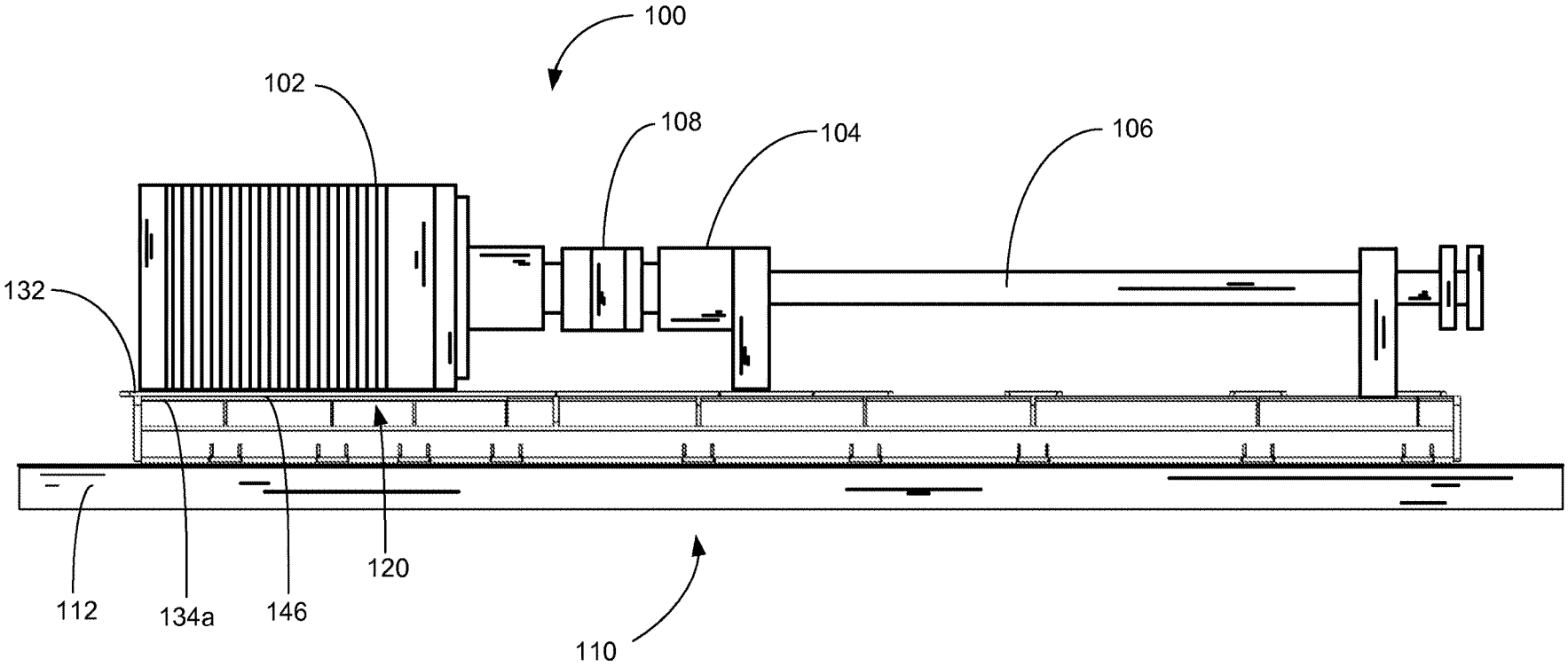
FIG. 1 is a side view of a horizontal pumping system constructed in accordance with a presently preferred embodiment.

In accordance with a preferred embodiment of the present invention, FIG. 1 shows a side view of a horizontal pumping system 100. The horizontal pumping system 100 includes a motor 102, a suction chamber 104, a pump 106 and a thrust chamber 108. The suction chamber 104 is connected between the pump 106 and the thrust chamber 108. The thrust chamber 108 is connected between the suction chamber 104 and the motor 102. Generally, the motor 102 drives the pump 106 through a series of shafts (not visible in FIG. 1) that extend through the thrust chamber 108 and suction chamber 104. Pumped fluids are provided to the suction chamber 104 and pressurized by the pump 106. In a preferred embodiment, the pump 106 is a centrifugal pump. In a particularly preferred embodiment, the pump 106 is a multistage centrifugal pump. Each of the components of the horizontal pumping system 100 is supported by a frame 110 that is in turn supported by a pad 112.

Figure 2:
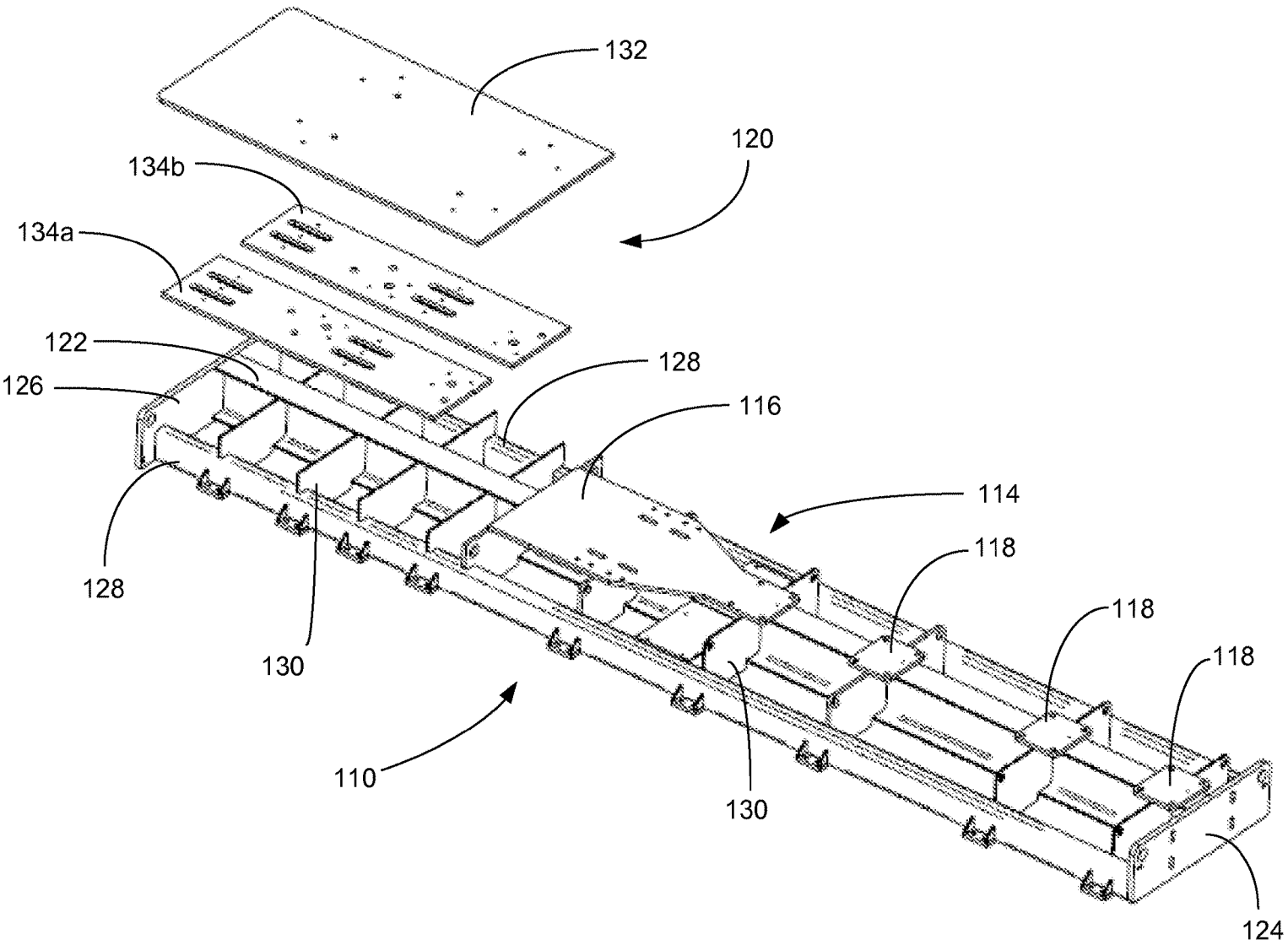
FIG. 2 is a perspective exploded view of the frame of the horizontal pumping system of FIG. 1.

Turning to FIG. 2, shown therein is a perspective view of the frame 110. The frame 110 includes a base assembly 114, a thrust chamber support plate 116, pump supports 118 and motor support assembly 120. The base assembly 114 includes a central support beam 122, a distal end plate 124, a proximal end plate 126, a pair of side rails 128 and a plurality of ribs 130 that extend substantially perpendicular to the central support beam 122 between the pair of side rails 128. In the presently preferred embodiments, the central support beam 122 is a steel I-beam and, unless otherwise specified, all of the components of the frame 110 are constructed from steel or another metal alloy.

In the presently preferred embodiment depicted in FIG. 2, the motor support assembly 120 includes an upper support plate 132 and a pair of lower support plates 134*a*, 134*b*. Although a single upper support plate 132 and a pair of lower support plates 134*a*, 134*b* is presently preferred, it will be appreciated that alternate embodiments include the use of a single lower support plate 134, and multiple upper support plates 132 in combination with one or more lower support plates 134.

Figure 4:
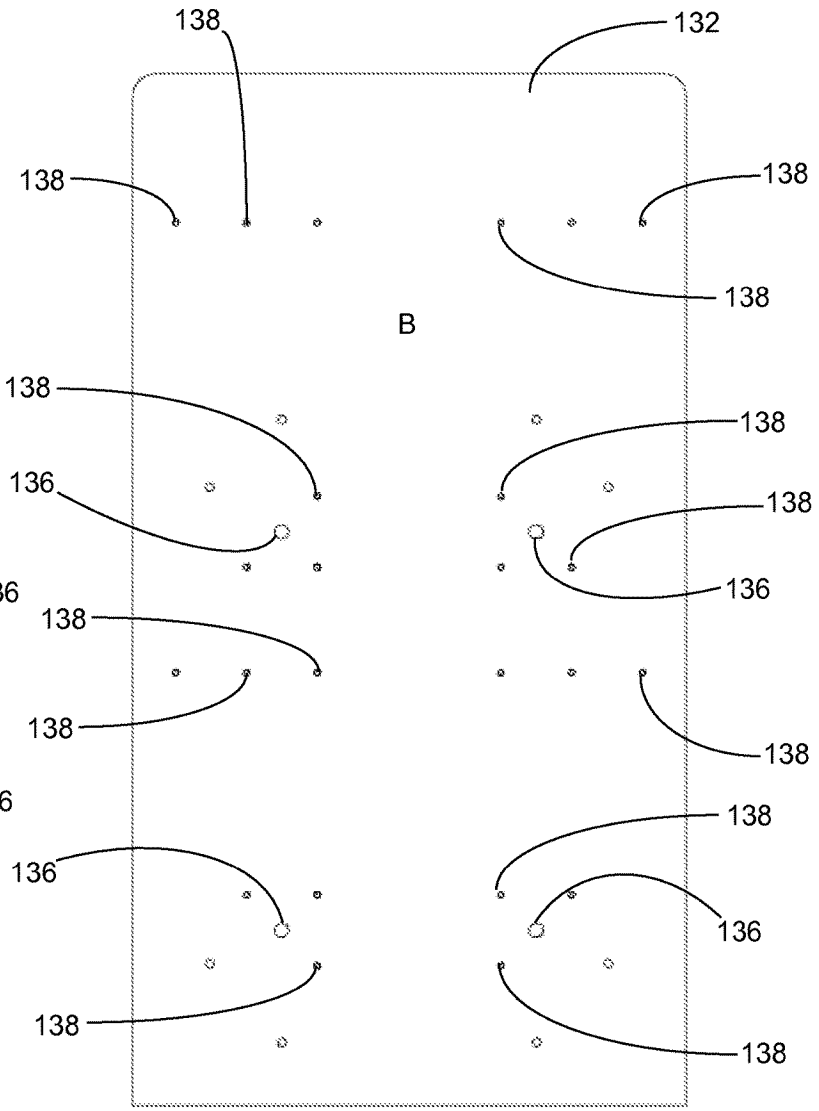
FIG. 4 is a bottom view of the upper support plate of the frame of FIG. 2.
Figure 3:
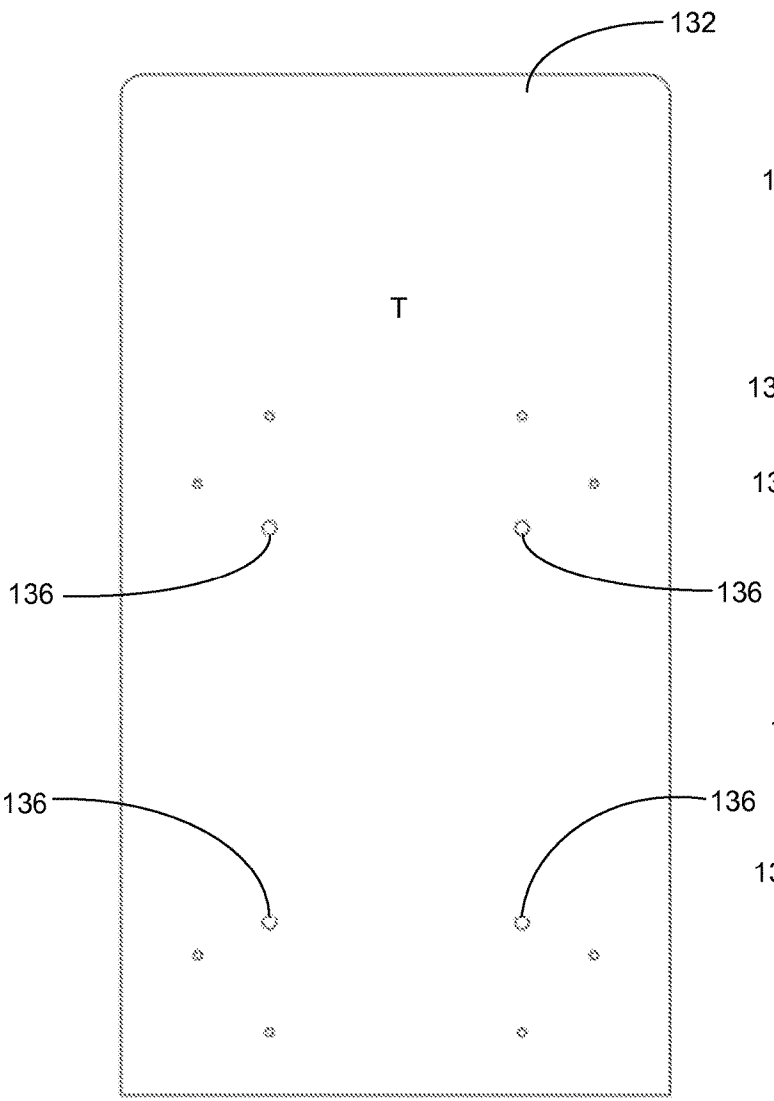
FIG. 3 is a top view of the upper support plate of the frame of FIG. 2.

Turning to FIGS. 3 and 4, shown therein are top and bottom views, respectively, of the upper support plate 132. The upper support plate 132 includes a plurality of upper motor mount holes 136 that are designed to accommodate bolts or studs extending downward from the motor mounts (not shown). As noted in the bottom view of the upper support plate 132 in FIG. 4, the upper motor mount holes 136 extend through the upper support plate 132. As also illustrated in FIG. 4, the upper support plate 132 further includes a plurality of upper connection taps 138 that are blind-tapped into the bottom of the upper support plate 132. The upper connection taps 138 do not extend through the upper support plate 132. In the particularly preferred embodiment depicted in FIG. 4, the upper support plate 132 includes three upper connection taps 138 around each of the upper motor mount holes 136 and several series of upper connection taps 138 disposed in a linear manner across the upper support plate 132. The upper support plate has a top surface "T" and bottom surface "B."

Figures 5, 6:
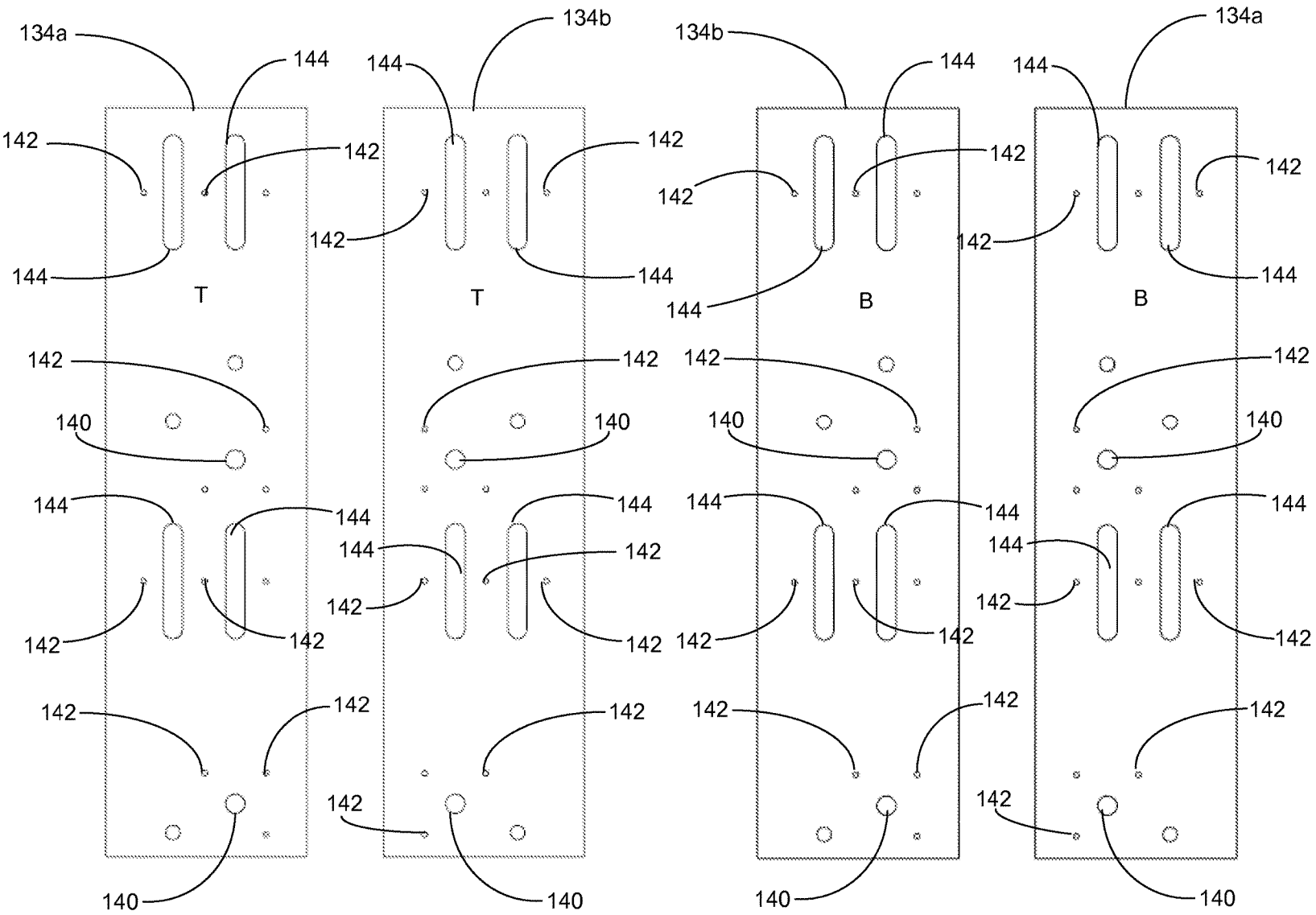
FIG. 5 is a top view of the lower support plates of the frame of FIG. 2.
FIG. 6 is a bottom view of the lower support plates of the frame of FIG. 2.

Turning to FIGS. 5 and 6, shown therein are top and bottom views, respectively, of the lower support plates 134*a*, 134*b*. The lower support plates 134*a*, 134*b* are intended to be supported on opposite sides of the central support beam 122. Although two lower support plates 134*a*, 134*b* are disclosed in the presently preferred embodiment, a single larger lower support plate 134 is contemplated as falling within the scope of alternate preferred embodiments. The lower support plates 134*a*, 134*b* each have a top surface "T" and bottom surface "B."

Each of the lower support plates 134*a*, 134*b* includes a plurality of lower motor mount holes 140, lower connection bores 142 and weld access apertures 144. The lower connection bores 142 pass through the lower support plates 134*a*, 134*b* and are aligned with the upper connection taps 138. During assembly, connection bolts (not shown) can be inserted through the lower connection bores 142, through the lower support plates 134*a*, 134*b* and into the upper connection taps 138 to bolt the lower support plates 134*a*, 134*b* to the upper support plate 132.

Similarly, the lower motor mount holes 140 are intended to be aligned with the upper motor mount holes 136 when the upper support plate 132 is placed on top of the lower support plates 134*a*, 134*b*. Motor mount bolts (not shown) can extend through the upper motor mount holes 136 in the upper support plate 132 through the lower motor mount holes 140 in the lower support plates 134*a*, 134*b*. In the presently preferred embodiments, the lower motor mount holes 140 have a circumference that is larger than the circumference of the upper motor mount holes 136. The larger circumference of the lower motor mount holes 140 permits a fillet weld to be made between the top surface of the lower plates 134*a*, 134*b* and the bottom surface of the upper support plate 132. In a particularly preferred embodiment, the lower motor mount holes 140 are sized about ⅝" to about ¾" larger than the corresponding upper motor mount holes 136.

To further connect the upper support plate 132 to the lower support plates 134*a*, 134*b*, the weld access apertures 144 provide access for additional welds to be made between the top surface of the lower support plates 134*a*, 134*b* and the adjacent and abutting bottom surface of the upper support plate 132. Although only four weld access apertures 144 are shown in FIGS. 5 and 6, it will be appreciated that additional or fewer weld access apertures 144 may also be used.

During assembly of the motor support assembly 120, the upper support plate is placed on top of, and aligned with, the lower support plates 134*a*, 134*b*. Once aligned, the lower support plates 134*a*, 134*b* are bolted to the bottom of the upper support plate 132 by threading assembly bolts (not shown) through the lower connection bores 142 into the upper connection taps 138 to preliminarily connect the lower support plates 134*a*, 134*b* to the upper support plate 132. In the particularly preferred embodiment depicted in FIGS. 3-6, twenty-four (24) assembly bolts are used to preliminarily connect the lower support plates 134*a*, 134*b* and upper support plate 132.

Once all of the assembly bolts have been sufficiently tightened, the lower support plates 134*a*, 134*b* are welded to the upper support plate 132. Bolting the upper support plate 132 to the lower support plates 134*a*, 134*b* before the welding begins reduces the risk of bubbling between the abutting upper support plate 132 and lower support plates 132*a*, 132*b*.

In the presently preferred embodiment, the first welds are made through the weld access apertures 144 to connect the top surface of the lower support plates 134*a*, 134*b* to the adjacent and abutting bottom surface of the upper support plate 132. Next, welds are made between the lower support plates 134*a*, 134*b* and the upper support plate 132 around the circumference of lower motor mount holes 140. Because the lower motor mount holes 140 are larger than the upper motor mount holes 136 and motor mount bolts (not shown), the step of welding through the lower motor mount holes 140 does not obstruct the placement of motor mounts or motor mount studs through the upper motor mount holes 136 and lower motor mount holes 140.

Turning back to FIG. 1, after the top surface of the lower support plates 134*a*, 134*b* has been sufficiently welded to the bottom surface of the upper support plate 132, a seam seal 146 is applied to the peripheral interface that extends around the outside edges of the upper support plate 132 and the lower support plates 134*a*, 134*b*. In the presently preferred embodiments, the seam seal 146 is applied by welding the upper support plate 132 to the lower support plates 134*a*, 134*b* along the outside edges of the upper support plate 132 and lower support plates 134*a*, 134*b*. The seam seal 146 prevents moisture and contaminants from entering the space between the upper support plate 132 and the lower support plates 134*a*, 134*b*. Although a welded seam seal 146 is presently preferred, gaskets manufactured from rubber, polymers, silicon or other synthetic material may be applied as an alternative to welding.

Thus, the preferred embodiments disclose a motor support assembly 120 that can be manufactured more easily and more cost effectively than a large unitary motor plate. The motor support assembly 120 includes an upper support plate 132 and lower support plates 134*a*, 134*b* that include both bolted and welded connections. The motor support assembly 120 provides a rigid support that resists buckling or bending when loaded. The manufacture of the motor support assembly 120 from multiple smaller component parts presents a significant advancement over a motor support manufactured from a unitary larger piece of material.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A method for manufacturing a motor support assembly useable for supporting a motor within a horizontal pumping system, the method comprising the steps of:

providing a lower support plate that includes a weld access aperture and a plurality of lower motor mount holes, wherein each of the lower motor mount holes has a lower motor mount hole circumference;

providing an upper support plate that includes a plurality of upper motor mount holes, wherein each of the upper motor mount holes has an upper motor mount hole circumference that is smaller than the lower motor mount hole circumference;

aligning the upper support plate and the lower support plate such that each of the plurality of lower mount holes is aligned with a corresponding one of the plurality upper motor mount holes;

welding the lower support plate to the upper support plate by applying a weld connecting the lower support plate and the upper support plate through the weld access aperture;

welding the lower support plate to the upper support plate by applying a weld through at least one of the plurality of lower motor mount holes; and extending motor mount bolts through the upper motor mount holes and lower motor mount holes after the step of welding the lower support plate to the upper support plate through at least one of the plurality of lower motor mount holes.

2. The method of claim 1, further comprising the steps of:

providing a plurality of upper connection taps in a bottom surface of the upper support plate, wherein each of the plurality of upper connection taps does not extend through an upper surface of the upper support plate;

providing a plurality of lower connection bores in the lower support plate, wherein the lower connection bores extend through the lower support plate; and temporarily fastening the lower support plate to the upper support plate by threading an assembly bolt through each of the lower connection bores into a corresponding upper connection tap before the step of welding the lower support plate to the upper support plate.

3. The method of claim 1, further comprising the step of applying a seam seal to an interface that extends along the abutting outside edges of the upper support plate and the lower support plate.

* * * * *